US011060252B2

(12) United States Patent
Aydin et al.

(10) Patent No.: US 11,060,252 B2
(45) Date of Patent: Jul. 13, 2021

(54) STRUCTURE FOR SUPPORTING AN INFORMATION OR SURVEILLANCE DEVICE ABOVE A ROAD

(71) Applicant: ORTANA ELEKTRONIK YAZILIM TAAH. SAN. VE TIC. A.S., Ankara (TR)

(72) Inventors: Umut Aydin, Ankara (TR); Gökhan Çelik, Ankara (TR)

(73) Assignee: ORTANA ELEKTRONIK YAZILIM TAAH. SAN. VE TIC. A.S., Ankara (TR)

( * ) Notice: Subject to any disclaimer, the term of this patent is extended or adjusted under 35 U.S.C. 154(b) by 129 days.

(21) Appl. No.: 16/040,914

(22) Filed: Jul. 20, 2018

(65) Prior Publication Data

US 2019/0063017 A1 Feb. 28, 2019

(30) Foreign Application Priority Data

Jul. 20, 2017 (EP) ..... 17182256

(51) Int. Cl.
*E01F 9/696* (2016.01)
*E04G 3/24* (2006.01)
(Continued)

(52) U.S. Cl.
CPC ..... *E01F 9/696* (2016.02); *E04G 3/24* (2013.01); *E04G 5/10* (2013.01); *E04G 5/14* (2013.01)

(58) Field of Classification Search
CPC .... E01F 1/00; E01F 9/696; E04G 5/10; E04G 5/14; E04G 3/24; E06C 9/06; E06C 9/08;
(Continued)

(56) References Cited

U.S. PATENT DOCUMENTS 1,002,146 A * 8/1911 Gore ..... E06C 9/08 182/77
1,094,844 A * 4/1914 Ellinger ..... E04B 1/19 52/646

(Continued)

FOREIGN PATENT DOCUMENTS

DE 19838604 A1 3/2000
DE 10153479 A1 5/2002

OTHER PUBLICATIONS

Extended European Search Report dated Jan. 4, 2018; Appln. No. 17182256.2.

*Primary Examiner* — Alvin C Chin-Shue
*Assistant Examiner* — Shiref M Mekhaeil

(57) ABSTRACT

The present invention relates to a structure for supporting an information or surveillance device above a road. The structure includes: at least one post extending upwards from the ground to an elevated position, at least one overhead beam which is supported by said post, the overhead beam extending over a horizontal distance above the road, at least one information or surveillance device being connected to said overhead beam and being positioned above the road, a catwalk extending along the overhead beam, wherein said catwalk comprises a guard rail assembly which is movable between: an operating position in which the guard rail assembly extends upwardly from a floor of the catwalk and protects personnel from falling from the catwalk, and a retracted, non-operating position in which the guard rail assembly is concealed behind the overhead beam when viewed from a direction of approaching traffic on the road.

19 Claims, 7 Drawing Sheets

(51) Int. Cl.
*E04G 5/10* (2006.01)
*E04G 5/14* (2006.01)

(58) Field of Classification Search
CPC ..... E01D 18/00; E04F 11/04; E04F 11/06; E04F 11/064; E04F 11/1865; E04F 2011/005; G09F 7/18; G09F 19/22; G09F 15/00
USPC ..... 52/64, 174; 182/77–81, 113; 116/28 R, 116/63 R, 200; 340/928; 40/612, 549, 40/624; 14/7; 248/544; 249/477
See application file for complete search history.

(56) References Cited

U.S. PATENT DOCUMENTS 1,346,787 A * 7/1920 Kryl ..... E06C 9/08 182/98
1,808,692 A * 6/1931 Sudduth ..... G09F 15/0018 40/612
2,642,217 A * 6/1953 Jennings ..... B60R 3/02 182/88
2,676,066 A * 4/1954 Woboril, Sr. ..... E04G 3/30 182/113
3,248,744 A * 5/1966 Hutt ..... A61G 7/0507 5/429
3,891,052 A * 6/1975 Lee, Sr. ..... E04B 1/34336 182/88
4,371,056 A * 2/1983 Anglade ..... E06C 5/02 182/106
4,492,049 A * 1/1985 Gaylor ..... G09F 15/0006 40/557
4,613,155 A * 9/1986 Greenwood ..... A01C 15/003 105/457
4,708,355 A * 11/1987 Tiede ..... B60R 3/02 182/89
4,759,437 A * 7/1988 Bevins ..... B64F 1/32 182/113
4,936,407 A * 6/1990 Brock ..... B60R 3/005 180/271
5,008,967 A * 4/1991 Barrios ..... E01F 9/696 14/7
5,237,932 A * 8/1993 Edwards ..... B61D 19/023 104/124
5,396,724 A * 3/1995 Dinsmore ..... G09F 19/00 160/57
5,634,529 A * 6/1997 Nguyen ..... E06C 5/06 182/113
5,749,436 A * 5/1998 Satchwell, III ..... B60R 3/005 182/113
5,921,531 A * 7/1999 Early ..... B61D 7/00 105/437
6,003,633 A * 12/1999 Rolson ..... E06C 5/02 182/106
6,006,861 A * 12/1999 Clinton ..... E01F 13/06 182/97
6,012,547 A * 1/2000 Sykes ..... B60P 1/02 182/113
6,045,157 A * 4/2000 Poulin ..... B60R 3/005 182/113
6,152,492 A * 11/2000 Markham ..... B60P 3/22 182/113
6,189,839 B1 * 2/2001 Lemieux ..... E01F 13/048 246/127
6,230,427 B1 * 5/2001 McDaniel ..... G09F 15/00 40/624
6,375,222 B1 * 4/2002 Wade ..... B60P 3/2205 220/562
7,165,649 B2 * 1/2007 Latimer ..... E04F 11/064 182/77
7,182,175 B1 * 2/2007 Schmitt ..... B63B 27/143 114/362
8,317,249 B2 * 11/2012 Slater ..... B60R 3/005 296/26.01
8,632,099 B2 * 1/2014 Conny ..... B60R 21/02 182/113
9,126,536 B2 * 9/2015 Meacham ..... E04G 5/14
9,403,486 B2 * 8/2016 May ..... B60R 3/005
9,481,314 B2 * 11/2016 Levi ..... B60R 3/005
9,487,145 B2 * 11/2016 Koshy ..... E02F 9/0816
9,573,629 B2 * 2/2017 Conny ..... B62D 33/0207
9,738,293 B2 * 8/2017 Williamson ..... B61L 5/1863
9,957,720 B1 * 5/2018 Brunner ..... E06C 1/34
10,100,576 B1 * 10/2018 Dimovski ..... E06C 1/34
2002/0189503 A1 * 12/2002 Hansen ..... B60R 3/005 108/44
2003/0020253 A1 * 1/2003 Albert Bosman ..... B60R 3/005 280/164.1
2003/0127284 A1 * 7/2003 Cook ..... B63B 27/146 182/86
2004/0173406 A1 * 9/2004 Lantz ..... B60R 3/005 182/113
2005/0102873 A1 * 5/2005 Poot ..... G09F 19/22 40/612
2005/0223608 A1 * 10/2005 Noble ..... G09F 7/18 40/611.07
2005/0241878 A1 * 11/2005 Cook ..... B60R 3/005 182/115
2006/0006023 A1 * 1/2006 Lim ..... B60R 3/02 182/127
2006/0251454 A1 * 11/2006 Ashton ..... B61L 5/1863 400/1
2008/0047184 A1 * 2/2008 Dean ..... G09F 15/0012 40/624
2008/0155869 A1 * 7/2008 Golle ..... G09F 13/22 40/544
2010/0192487 A1 * 8/2010 Thornton ..... E04F 11/064 52/183
2012/0092188 A1 * 4/2012 Gielblat ..... E01F 9/696 340/928
2013/0256057 A1 * 10/2013 Kasinski ..... E04F 11/06 182/81
2014/0020194 A1 * 1/2014 Trogl ..... E01F 9/696 14/69.5
2016/0049899 A1 * 2/2016 Gauthier ..... H02S 20/21 52/173.3
2016/0145881 A1 * 5/2016 Moran ..... E04G 5/142 182/113
2017/0335583 A1 * 11/2017 Moran ..... E04G 21/3228
2018/0135307 A1 * 5/2018 Moran ..... E04G 21/3228
2019/0135185 A1 * 5/2019 Oliver ..... B60R 3/005
2019/0352920 A1 * 11/2019 Salyer ..... B60R 3/005

* cited by examiner

STRUCTURE FOR SUPPORTING AN INFORMATION OR SURVEILLANCE DEVICE ABOVE A ROAD

FIELD OF THE INVENTION

The present invention relates to a structure for supporting an information or surveillance device above a road. Such structures are known.

BACKGROUND OF THE INVENTION

A structure for supporting an information or surveillance device above a road needs to comply with many requirements. If the structure carries an information device, the information device needs to be clearly visible for the approaching traffic. The structure needs to be safe and strong. The structure needs to be free of any visual distractions which might distract drivers in vehicles and result in unsafe traffic situations. The structure needs to be accessible for personnel for maintenance, repair or inspection work. General requirements such as costs, ease of installation and sufficient technical and economic lifespan also apply.

On highways with multiple lanes, such structures generally are built as gantries, because signs posted on the side of the highway would be difficult for drivers to see. Gantries may be supported on one side of the road only and cantilever above the road or (sometimes referred to as a half-gantry or Butterfly gantry), or they may be bridges comprising an overhead beam and posts on each side of the road. Multiple road signs may be mounted on one overhead beam, but a single large screen may also be mounted onto the overhead beam. The single large screen may comprise various road signs, including lights an textual information. The screen may be electronically controlled in order to change the information which is presented to drivers, or may be a non-electronic screen with fixed information. Surveillance equipment such as cameras and traffic signs or toll collection equipment may also be included.

There is continuous need to improve such road sign structures.

US2012/0092188A1 discloses a road gantry having a gangway and railings. The gantry comprises at least one arm adapted to carry a sign, signalling device, camera, etc., wherein the arm is pivotable between a first position in which it extends toward the road and a second retracted position in which it is retracted onto the gangway. This configuration prevents tools of a maintenance personnel from falling on the road below.

WO2003/080936A1 discloses a road traffic structure having guard rails and a ladder.

U.S. Pat. No. 5,008,967 discloses a triangular truss walk-out cantilever for displaying road signs with a catwalk which allows easy access.

US2014/0020194A1 discloses a gantry for suspending at least one component. The gantry comprises at least one vertical guide rail 9 (see FIG. 2 of US2014/0020194A1) and a carriage 10 which is guided by the guide rail in a moveable manner and on which the component can be mounted. The carriage can be lofted and lowered with a hoisting system comprising a cable 27 and a winch 29.

U.S. Pat. No. 8,397,868B1 discloses a signal mast for a railway. The signal mast has a collapsible worker support. This reduces the assembly and installation time and effort.

It was recognized in the present invention that the structures of the prior art have shortcomings. These shortcomings relate to safety of traffic, visual clarity of the road signs to drivers, visually distracting parts which might distract drivers, safety for personnel, wind loads and a relatively high risk that non-authorized persons may climb onto the road sign structure.

OBJECT OF THE INVENTION

It is an object of the present invention to provide a structure for supporting an information or surveillance device above a road which has less visual distraction for drivers, thereby improving traffic safety.

It is an object of the present invention to provide a road sign structure which results in reduced wind loads on the structure.

It is an object of the present invention to provide a road sign structure which has a reduced risk of intruders climbing on the road sign structure and an improved access for authorized personnel.

SUMMARY OF THE INVENTION

In order to achieve at least one object, a structure is provided for supporting an information or surveillance device above a road, the structure comprising:

- at least one post extending upwards from the ground to an elevated position,
- at least one overhead beam which is supported by said post, the overhead beam extending over a horizontal distance above the road,
- at least one information or surveillance device being connected to said overhead beam and being positioned above the road,
- a catwalk extending along the overhead beam, wherein said catwalk comprises a guard rail assembly which is movable between:

- an operating position in which the guard rail assembly extends upwardly from a floor of the catwalk and protects personnel from falling from the catwalk, and
- a retracted, non-operating position in which the guard rail assembly is concealed behind the overhead beam when viewed from a direction of approaching traffic on the road.

Because the guard rail assembly is concealed for approaching traffic., there is less visual distraction for the approaching traffic which improves safety. The wind loads on the structure are also reduced, because in the retracted position the guard rail assembly is behind the overhead beam and does not catch wind.

In an embodiment, the guard rail assembly may be pivotable and comprises at least one handrail and pivotable struts which connect the handrail with a lower part of the catwalk, wherein the struts are pivotable between a substantially upright orientation in the operating position and a substantially horizontal orientation in the retracted, non-operating position. This pivotable movement results in a simple construction and in an easy and effective concealment.

In an embodiment, the guard rail assembly may be a foldable structure, wherein the struts are pivotable at their lower ends about respective lower horizontal pivot axes and pivotably connected to the handrail at their upper ends. This type of structure provides a simple and reliable movement from the operating position to the retracted position and vice versa. This results in a compact configuration in the retracted position, making it relatively easy to conceal the guard rail assembly between the relatively thin overhead beam.

In an embodiment, the horizontal pivot axes of the pivotable struts may extend at right angles to the overhead beam. This provides a simple and low cost solution.

In an embodiment, in the retracted position, the guard rail assembly may be located at the level of the overhead beam and is more in particular located above a lower side of the overhead beam and below an upper side of the overhead beam. In this way the approaching traffic cannot see the retracted guard rail assembly.

In an embodiment, the structure further may comprise at least one actuator for moving said guard rail between the operating position and the retracted position. The use of an actuator makes it easy for personnel to move the guard rail assembly between the operating position and the retracted position.

In an embodiment, the at least one actuator may be concealed behind the overhead beam. This further reduces visual distractions for the approaching traffic. The at least one actuator may be a hydraulic or pneumatic cylinder or an electric drive.

In an embodiment, the guard rail assembly may comprise a left guide rail assembly part comprising a left handrail supported by left pivotable struts and a right guide rail assembly part comprising a right handrail supported by right pivotable struts. This variant provides protection against falling on both sides of the catwalk. The left guide rail assembly part is positioned on the front side and the right guide rail assembly part is positioned on the rear side, when seen in the direction of approaching traffic.

In an embodiment, at least one left pivotable strut may comprise a left extension which extends to below the pivot axis of said strut, wherein at least one right pivotable strut comprises a right extension which extends to below the pivot axis of said strut, wherein the left pivotable strut is connected to the right pivotable strut via a horizontal beam which is connected to the left and right extension, and wherein the actuator is connected to the horizontal beam or to one of the extensions below the pivot axis. This embodiment allows the actuator to be positioned below a floor of the catwalk, behind the overhead beam and out of the way of personnel.

In an embodiment, the structure may comprise a ladder which is movable between:

- an operating position in which the ladder provides access for personnel to climb onto the catwalk, and
- a retracted, non-operating position in which the ladder is inaccessible from the ground and is concealed behind the overhead beam when viewed from the direction of approaching traffic.

The concealed ladder further reduces visual distraction for the drivers of approaching vehicles.

In an embodiment, the ladder may be pivotable about a horizontal ladder pivot axis which extends substantially perpendicular to the overhead beam. This was found to be a simple and effective construction.

In an embodiment, the ladder pivot axis may be located behind a connection between the post and the overhead beam. In this way the hinges which connect the ladder to the structure are also concealed.

In an embodiment, in the operating position the ladder is concealed behind the post. This provides the benefit that the ladder is concealed in both the operating position and the retracted position.

In an embodiment, the structure comprises a ladder actuator for moving the ladder between the operating position and the retracted position. This facilitates the operation of the ladder.

In an embodiment, the actuators for the guard rail assembly and/or the ladder may be locally or remotely controlled. In case of local control, a control panel may be provided on the post, or the actuators may be operable with a mobile device, such as a mobile phone, which is held by the operator at the location of the structure. The structure then comprises a wireless communication device coupled to the actuator(s). In case of remote control, the actuators may be operable from a central control location such as a central traffic control room. The connection between the traffic control room and the actuators may be wired or wireless.

These and other aspects of the invention will be more readily appreciated as the same becomes better understood by reference to the following detailed description and considered in connection with the accompanying drawings in which like reference symbols designate like parts.

LIST OF FIGURES

DETAILED DESCRIPTION OF THE FIGURES

Figure 1:
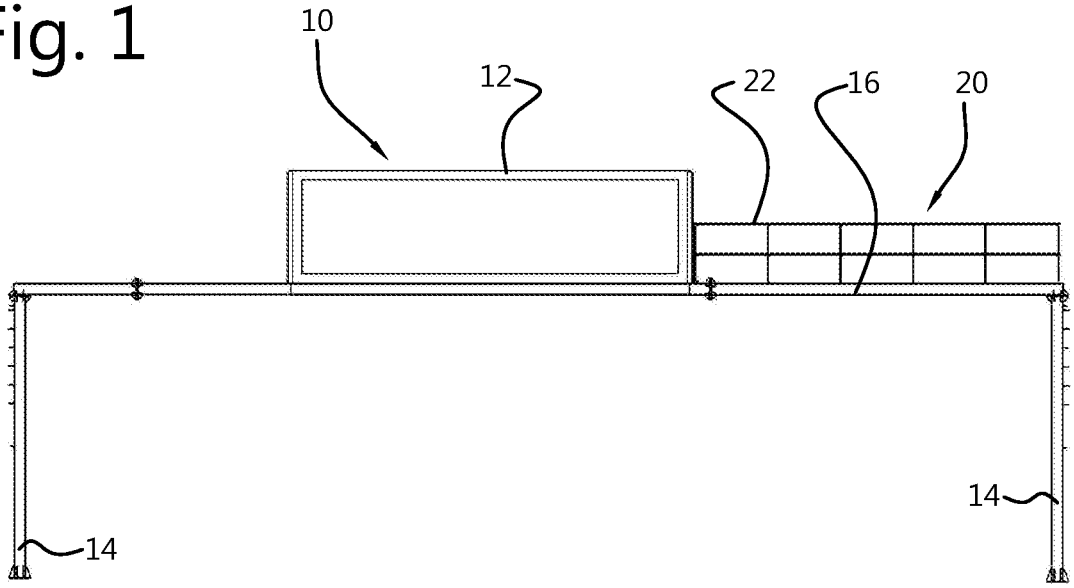
FIG. 1 shows a front view of the structure according to the invention with the guard rail assembly in an operating position.

Turning to FIGS. 1-4, the structure 10 for supporting information or surveillance devices 12 above a road is shown. The structure 10 comprises at least one post 14 extending upwards from the ground to an elevated position. The structure may comprise a single post on one side of the road but may also comprise a left and right post. If the structure only comprises one post, it cantilevers above the road.

The structure 10 comprises at least one overhead beam 16 which is supported by said post. The overhead beam extends over a horizontal distance above the road. The post(s) 14 and the overhead beam 16 can be made of a suitable construction material, such as steel, aluminium or any other suitable construction material.

The structure 10 comprises at least one information or surveillance device 12 being connected to said overhead beam and being positioned above the road. In the shown embodiment, the information or surveillance device is a screen for showing information the traffic. The screen faces the direction of approaching traffic. It will be understood that many different information or surveillance devices may be used, such as traffic lights, road signs, cameras, toll collection devices. The structure may support a single information or surveillance device or multiple information or surveillance devices. Different information or surveillance devices may be provided on a single structure.

The structure 10 comprises a catwalk 18 extending along the overhead beam 16. The catwalk allows personnel to access the structure and to carry out maintenance or repair works on the structure, and in particular on the information or surveillance device 12. The catwalk comprises a floor 19 to support the personnel. The floor 19 may be a grating or similar open structure. Part of the floor 19 is not shown in order to more clearly show the other parts of the structure.

The catwalk 18 comprises a guard rail assembly 20. The guard rail assembly is configured to provide safety to the personnel and to protect personnel from falling from the catwalk. The guard rail assembly is movable between an operating position in which the guard rail assembly extends upwardly from a floor of the catwalk and protects personnel from falling from the catwalk, and a retracted, non-operating position. FIG. 1 shows the guard rail assembly 20 in the operating position.

Figure 2:
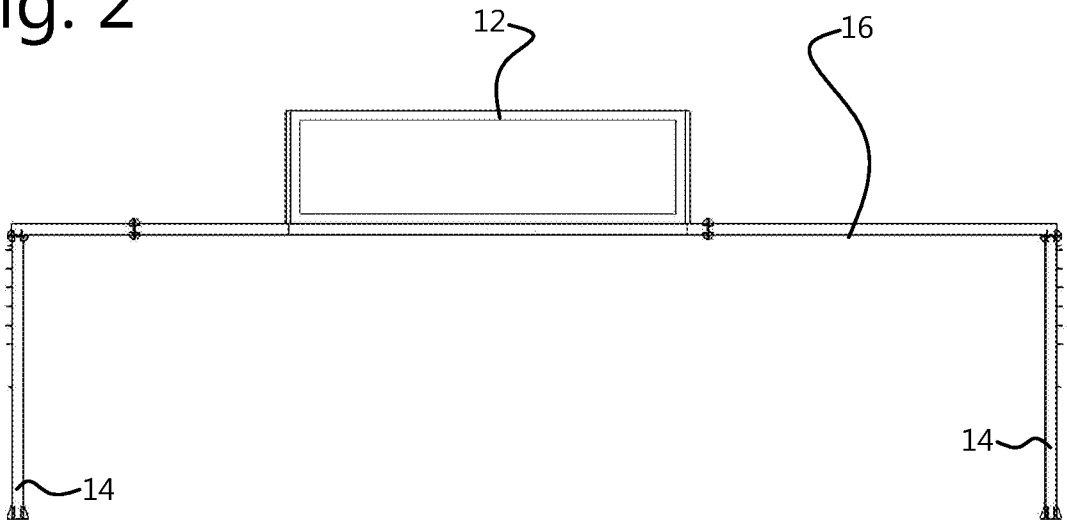
FIG. 2 shows a front view of the structure according to the invention with the guard rail assembly in a retracted position.
Figure 3:
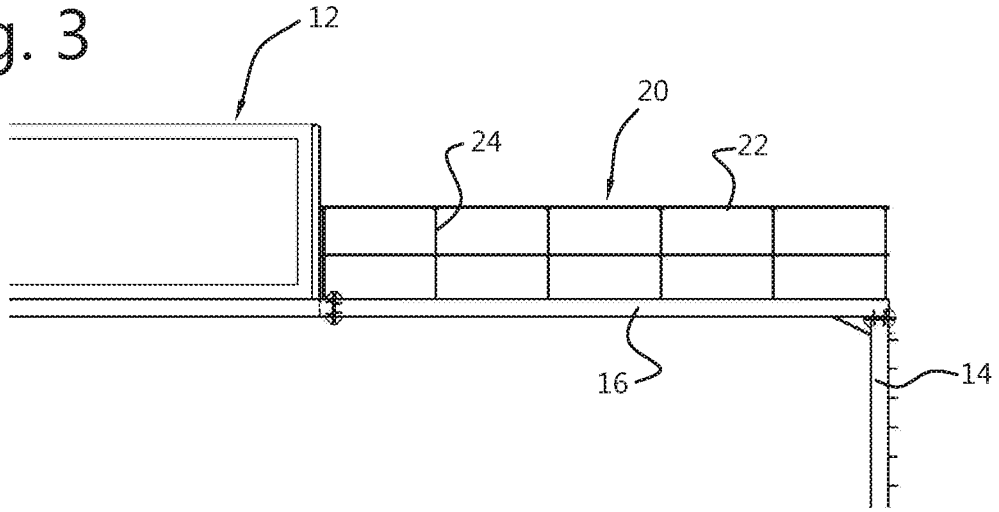
FIG. 3 shows a partial front view of the structure according to the invention with the guard rail assembly in an operating position.
Figure 4:
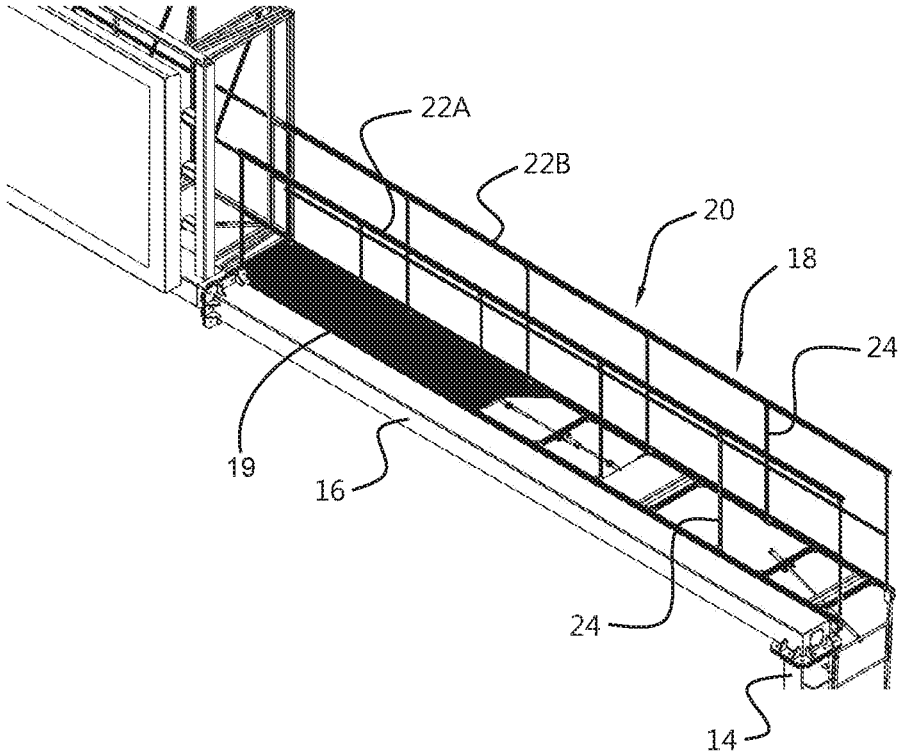
FIG. 4 shows a partial isometric view from front side of the structure according to the invention with the guard rail assembly in an operating position.

FIG. 2 shows the guard rail assembly in the non-operating position. In the non-operating position, the guard rail assembly is concealed behind the overhead beam when viewed from a direction of approaching traffic on the road. This provides a benefit in that the guard rail does not distract traffic. In case the structure carries an information device, the attention of the approaching traffic is better drawn to the information device. The concealed position also reduces wind loads on the structure 10.

The guard rail assembly 20 is pivotable and comprises at least one handrail 22 and pivotable struts 24 which connect the handrail with a lower part 26 of the catwalk. The handrail 22 extends horizontally. The pivotable struts extend vertically in the operating position.

Figure 5:
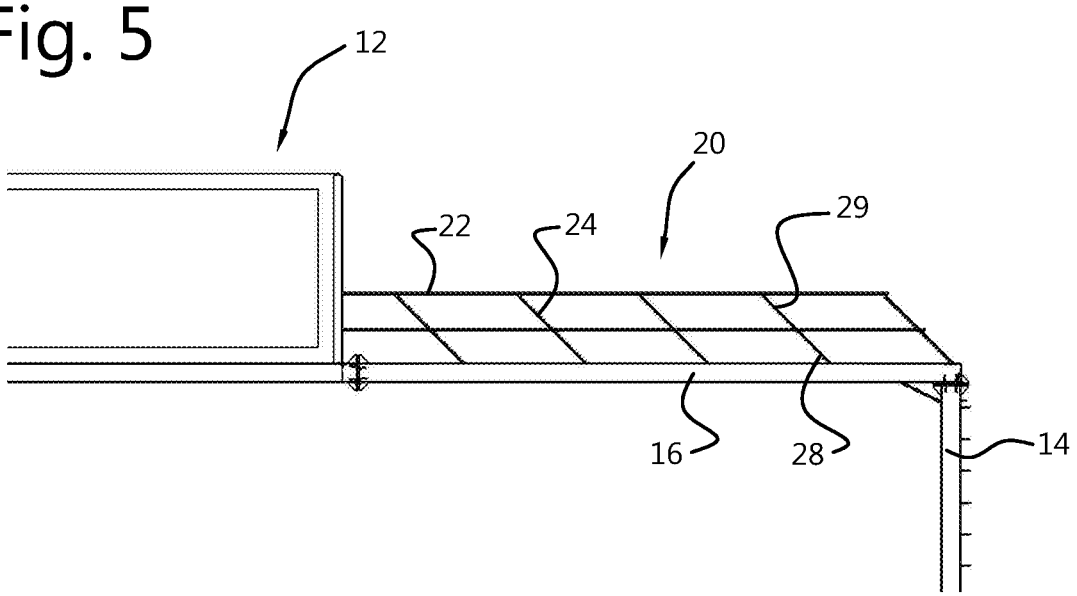
FIG. 5 shows a partial front view of the structure according to the invention with the guard rail assembly in an intermediate position between the operating position and the retracted position.
Figure 6:
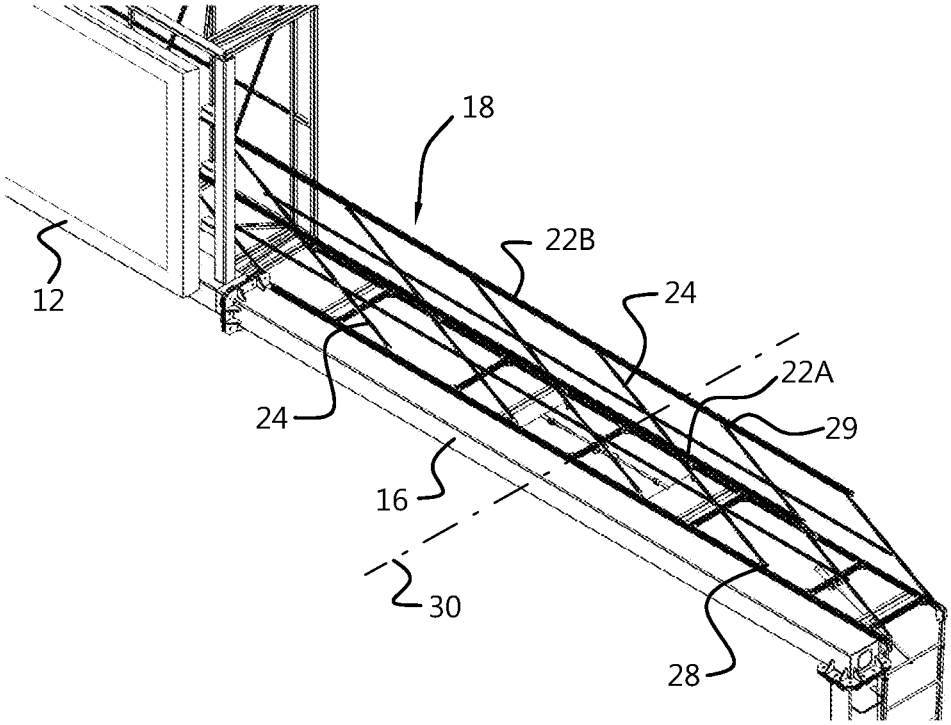
FIG. 6 shows a partial isometric view of the structure according to the invention with the guard rail assembly in an intermediate position between the operating position and the retracted position.

Turning to FIGS. 5 and 6, the struts 24 are pivotable between a substantially upright orientation in the operating position and a substantially horizontal orientation in the retracted, non-operating position. The guard rail assembly 20 is a foldable structure, wherein the struts are pivotable at their lower ends 28 about respective lower horizontal pivot axes 30 and pivotably connected to the handrail at their upper ends 29.

The horizontal pivot axes 30 of the pivotable struts 24 extend at right angles to the overhead beam 16.

Figure 7:
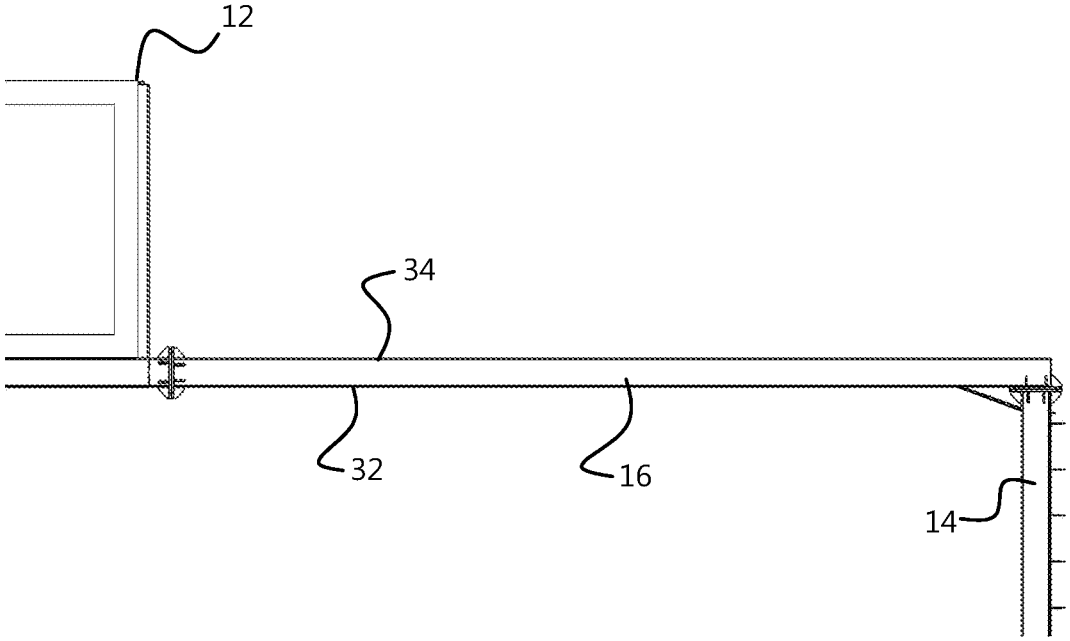
FIG. 7 shows a partial front view of the structure according to the invention with the guard rail assembly in the retracted position.
Figure 8:
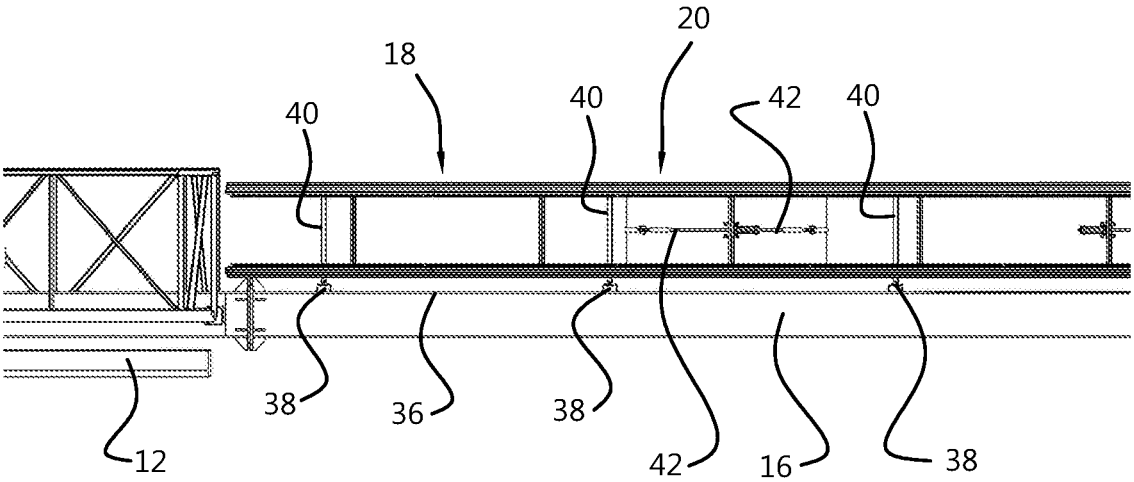
FIG. 8 shows a partial top view of the structure according to the invention with the guard rail assembly in the retracted position.

Turning to FIGS. 7 and 8, in the retracted position, the guard rail assembly 20 is located at the level of the overhead beam 16. The guard rail assembly is in particular located above a lower side 32 of the overhead beam and below an upper side 34 of the overhead beam. The catwalk 18 including the guard rail assembly 20 is connected to a rear side 36 of the overhead beam 16 via connectors 38 and lateral beams 40 which extend rearward from the overhead beam.

The structure 10 comprises at least one actuator 42 for moving said guard rail between the operating position and the retracted position. The at least one actuator 42 is concealed behind the overhead beam 16. The at least one actuator 42 may be a hydraulic or pneumatic cylinder or an electric drive.

Figure 9:
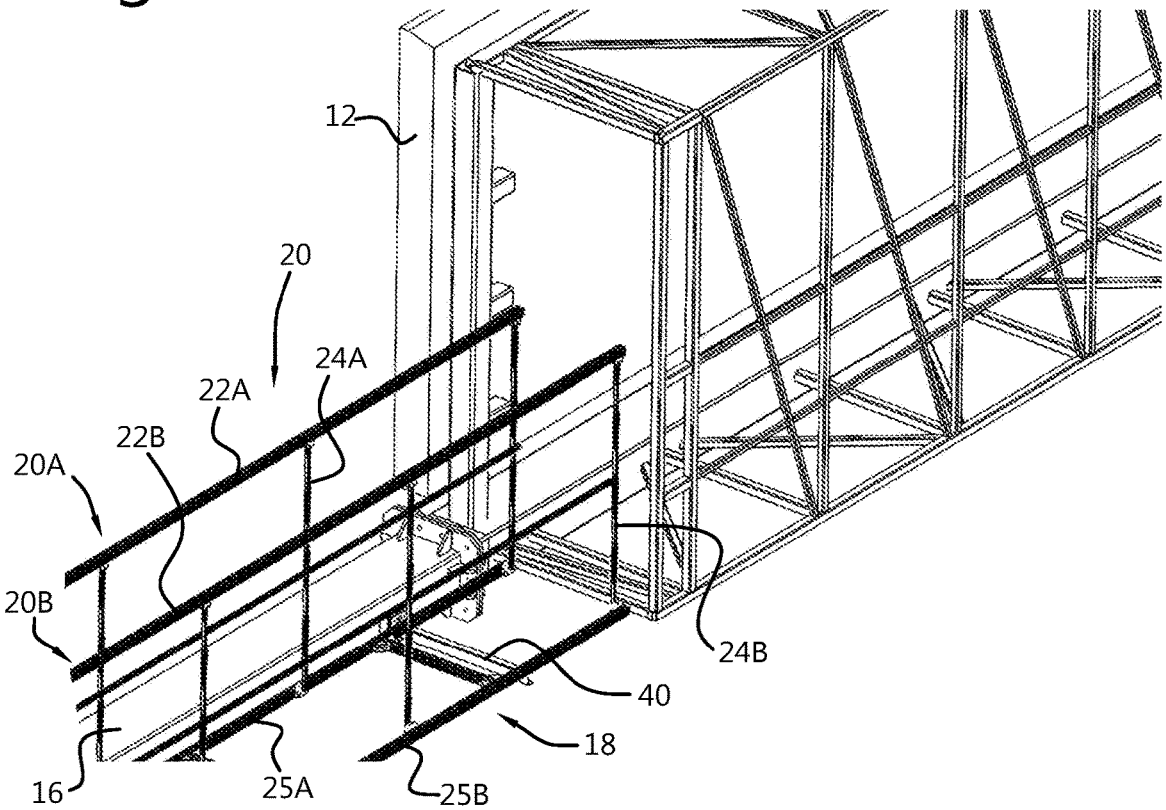
FIG. 9 shows a partial isometric view from the rear side of the structure according to the invention with the guard rail assembly in an operating position.
Figure 10:
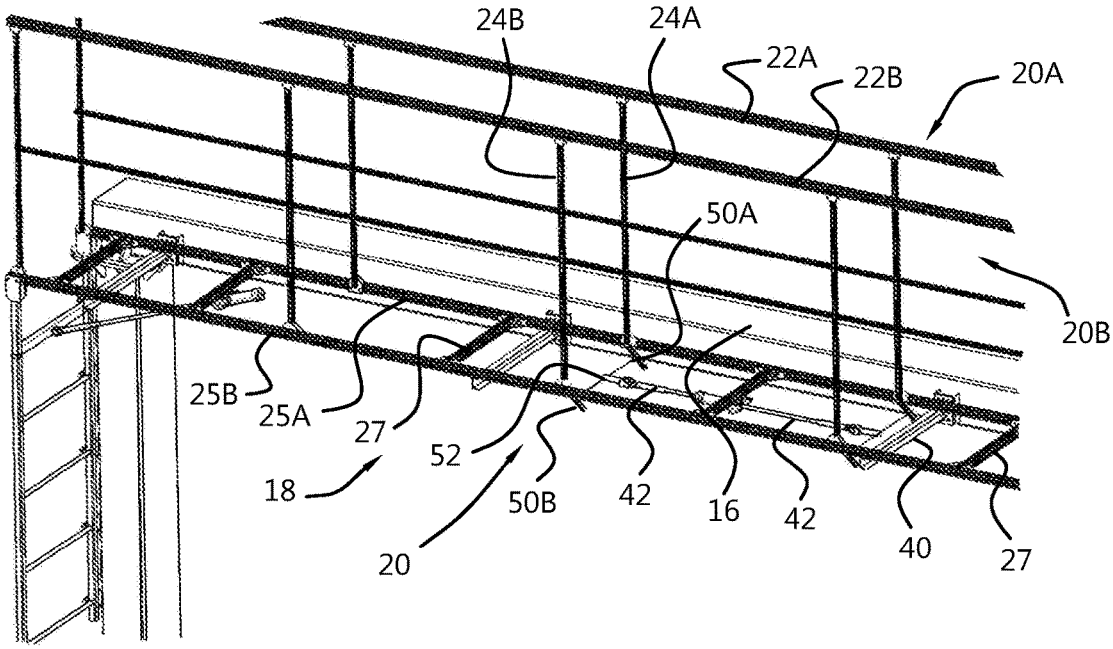
FIG. 10 shows another partial isometric view from the rear side of the structure according to the invention with the guard rail assembly in an operating position.
Figure 11:
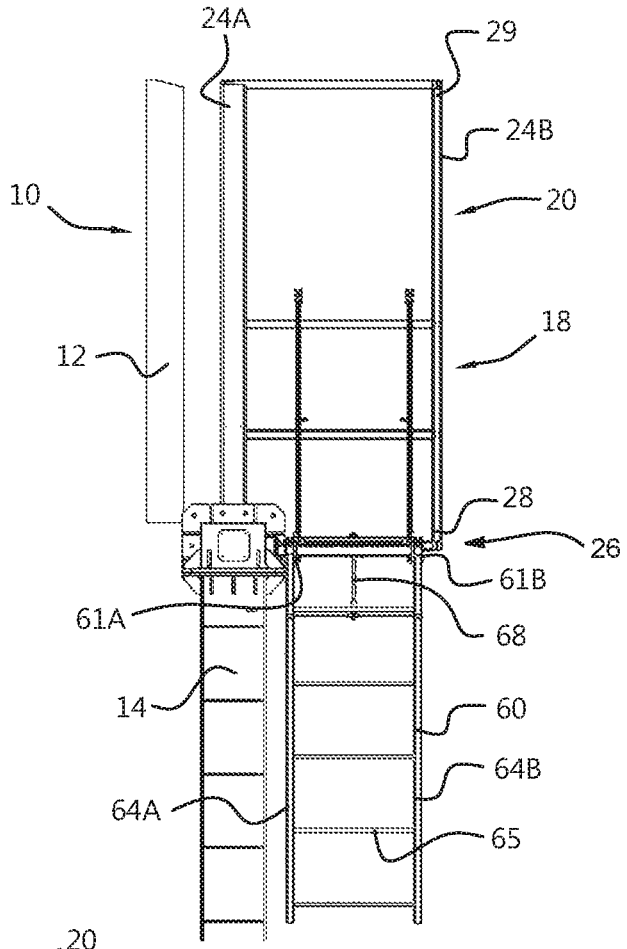
FIG. 11 shows a partial side view of the structure according to the invention with the ladder.
Figure 12:
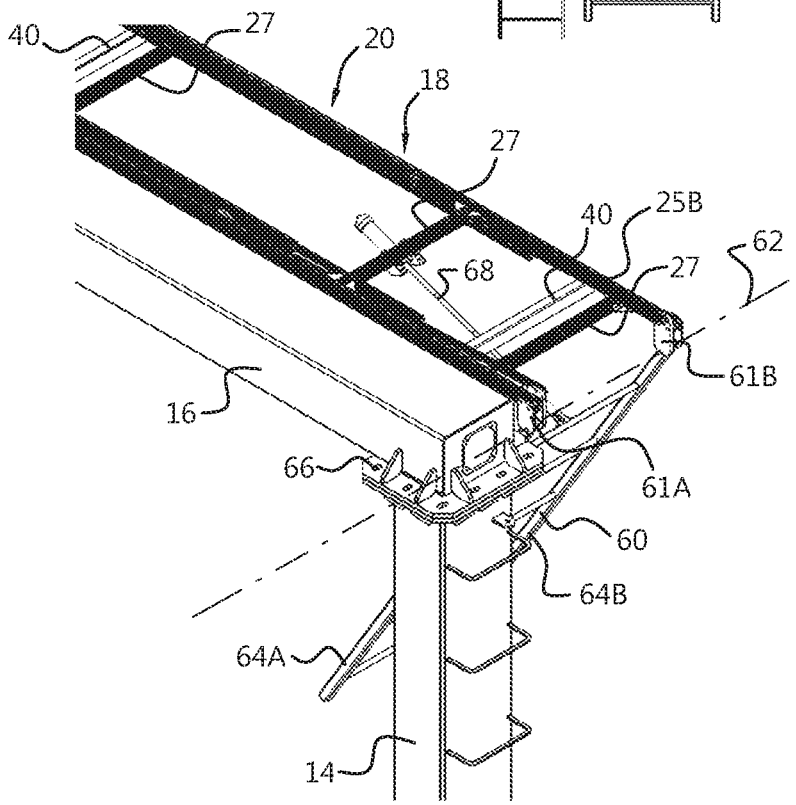
FIG. 12 shows a partial isometric view of the structure according to the invention with the ladder in an intermediate position.
Figure 13:
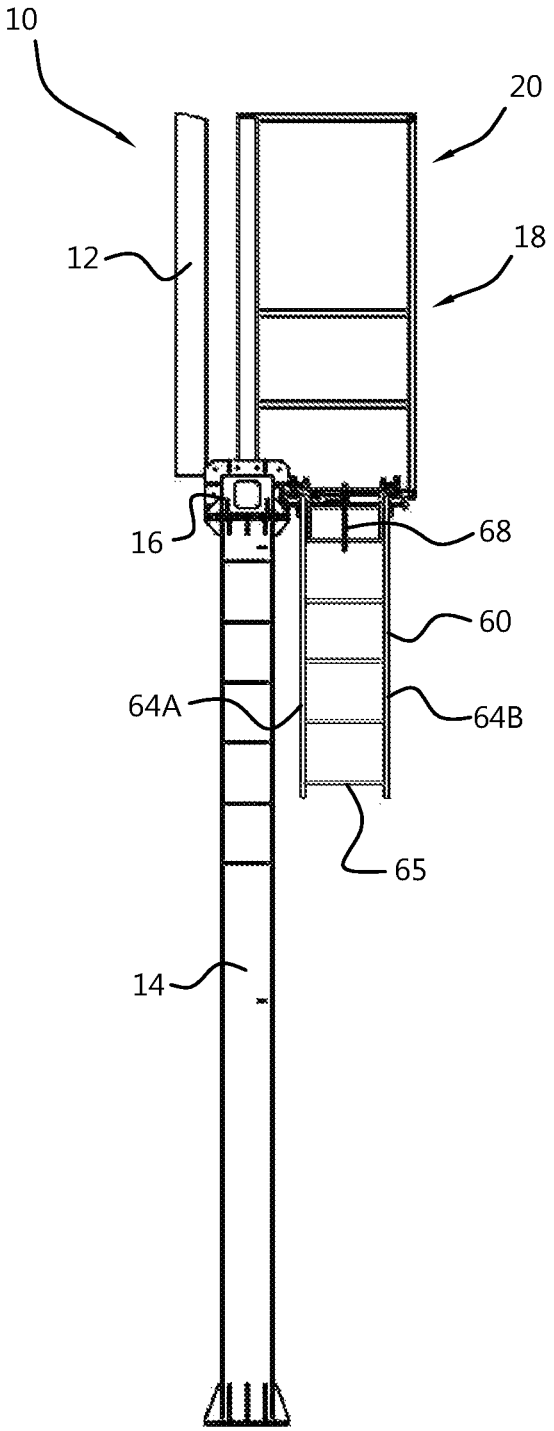
FIGS. 13 and 14 show side views of the structure according to the invention with the ladder in respectively the operating position and the retracted position.
Figure 14:
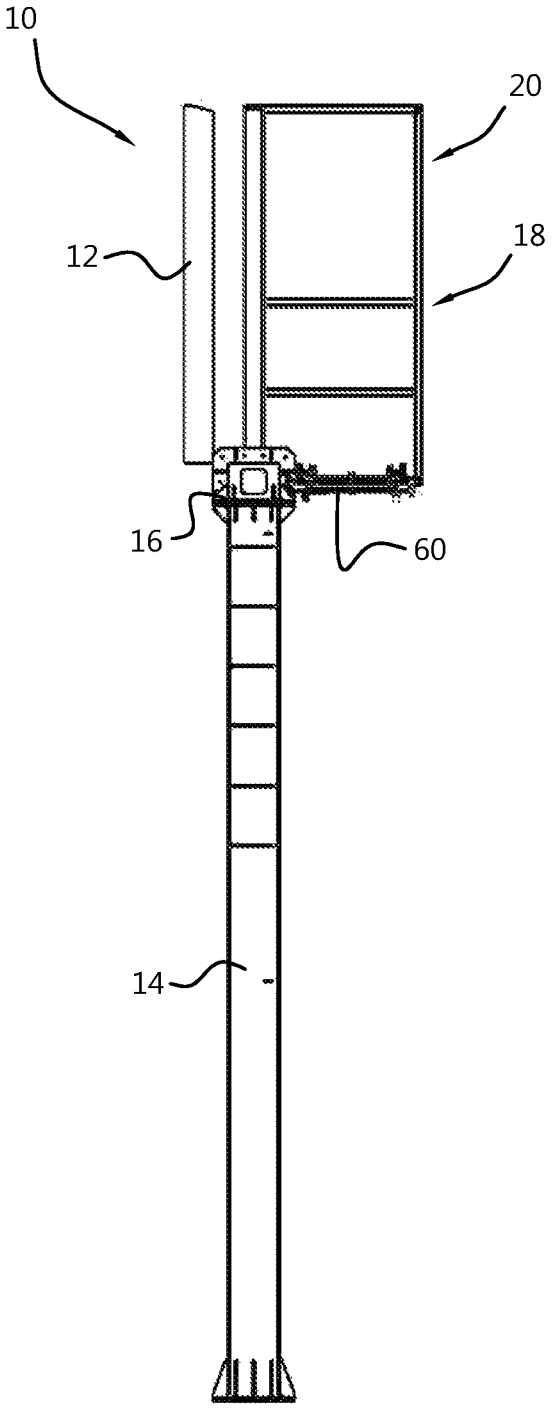

Turning to FIGS. 9 and 10, the guard rail assembly comprises a left guide rail assembly part 20A comprising a left handrail 22A supported by left pivotable struts 24A and a right guide rail assembly part 20B comprising a right handrail 22B supported by right pivotable struts 24B. The left struts 24A are pivotably connected to a lower left longitudinal beam 25A, and the right struts 24B are pivotably connected to a lower right longitudinal beam 25B. The lower left longitudinal beam 25A and the lower right longitudinal beam 25B are interconnected via separate connecting beams 27. The handrails are commonly denoted as 22, the struts are commonly denoted as 24, and the longitudinal beams are commonly denoted as 25 and also referred to as lower part 25 of the catwalk.

The guard rail assembly 20 extends from the post 14 to the information or surveillance device 12, but may extend along the entire overhead beam 16.

At least one left pivotable strut 24A comprises a left extension 50A which extends to below the pivot axis 30 of said strut. At least one right pivotable strut 24B comprises a right extension 50B which extends to below the pivot axis 30 of said strut 24B. The left pivotable strut 24A is connected to the right pivotable strut 24B via a horizontal beam 52 which is connected to the left and right extensions 50A, 50B (commonly denoted as 50). The actuator 42 is connected to the horizontal beam 52 or to one of the extensions 50A, 50B below the pivot axis. The actuator 42 is located below the floor of the catwalk 18.

Turning to FIGS. 11, 12, 13 and 14, the structure 10 comprises a ladder 60. The ladder provides access to the catwalk from the ground. The ladder 60 is movable between:

- an operating position in which the ladder provides access for personnel to climb onto the catwalk, and
- a retracted, non-operating position in which the ladder is inaccessible from the ground and is concealed behind the overhead beam 16 when viewed from the direction of approaching traffic.

This further reduces visual distraction of the structure to the traffic. It also further reduces the wind loads on the structure.

The ladder comprises a left pole 64A and a right pole 64B and horizontal supports 65. The ladder 60 is connected to the catwalk 18 via a left hinge 61A and a right hinge 61B.

The ladder 60 is pivotable about a horizontal ladder pivot axis 62 which extends substantially perpendicular to the overhead beam 16. The ladder pivot axis 62 is located behind a connection 66 between the post 14 and the overhead beam 16.

A ladder actuator 68 is provided with which the ladder 60 can be moved between the operating position and the retracted position. The ladder actuator 68 extends between one of the connecting beams 27 and the upper support 65 and may be a hydraulic or pneumatic cylinder or an electric drive.

In the operating position, the ladder 60 is concealed behind the post 14.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The invention claimed is:

1. A structure for supporting at least one information or surveillance device above a road, the structure comprising:

at least one post extending upwards from the ground to an elevated position, a single overhead beam which is supported by said post, the single overhead beam extending over a horizontal distance above the road, the at least one information or surveillance device being connected to said single overhead beam and being positioned above the road, a catwalk extending along the single overhead beam, wherein said catwalk comprises a guard rail assembly which is movable between:

an operating position in which the guard rail assembly extends upwardly from a lower part of the catwalk and protects personnel from falling from the catwalk, wherein in the operating position the guard rail assembly extends to above the single overhead beam, wherein the portion of the guard rail assembly which extends to above the single overhead beam is visible for approaching traffic, and a retracted, non-operating position in which the guard rail assembly is concealed behind the single overhead beam when viewed from a direction of approaching traffic on the road;

wherein the guard rail assembly comprises a left guide rail assembly part extending along one side of the catwalk and comprising a left handrail supported by left pivotable struts, and a right guide rail assembly part extending along an other side of the catwalk and comprising a right handrail supported by right pivotable struts.

2. The structure according to claim 1, wherein each of the pivotable struts connects its respective handrail with the lower part of the catwalk, and wherein the pivotable struts are pivotable between a substantially upright orientation in the operating position and a substantially horizontal orientation in the retracted, non-operating position.

3. The structure according to claim 2, wherein the guard rail assembly is a foldable structure, wherein each of the struts includes a lower end and an upper end, and the struts are pivotable at their lower ends about respective lower horizontal pivot axes and pivotably connected to the handrail at their upper ends.

4. The structure according to claim 3, wherein the horizontal pivot axes of the pivotable struts extend at right angles to the single overhead beam.

5. The structure according to claim 2, wherein at least one left pivotable strut comprises a left extension which extends to below the pivot axis of said strut, wherein at least one right pivotable strut comprises a right extension which extends to below the pivot axis of said strut, wherein the left pivotable strut is connected to the right pivotable strut via a horizontal beam which is connected to the left and right extension, and wherein the actuator is connected to the horizontal beam or to one of the extensions below the pivot axis.

6. The structure according to claim 5, comprising a ladder which is movable between:

a ladder operating position in which the ladder provides access for personnel to climb onto the catwalk, and a ladder retracted, non-operating position in which the ladder is inaccessible from the ground and is concealed behind the single overhead beam when viewed from the direction of approaching traffic.

7. The structure according to claim 1, wherein in the retracted position, the guard rail assembly is located above a lower side of the single overhead beam and below an upper side of the single overhead beam.

8. The structure according to claim 1, further comprising at least one actuator for moving said guard rail between the operating position and the retracted position.

9. The structure according to claim 8, wherein the at least one actuator is concealed behind the single overhead beam.

10. The structure according to claim 1, wherein the at least one actuator is a hydraulic or pneumatic cylinder or an electric drive.

11. The structure according to claim 1, wherein the guard rail assembly comprises a left guide rail assembly part comprising a left handrail supported by a plurality of left pivotable struts and a right guide rail assembly part comprising a right handrail supported by a plurality of right pivotable struts.

12. The structure according to claim 11, wherein each of the plurality of left and right pivotable struts defines a pivot axis of said strut, wherein at least one of the plurality of left pivotable struts comprises a left extension which extends to below the pivot axis of said strut, wherein at least one of the plurality of right pivotable struts comprises a right extension which extends to below the pivot axis of said strut, wherein the left pivotable strut is connected to the right pivotable strut via a horizontal beam which is connected to the left and right extensions, and wherein the actuator is connected to the horizontal beam or to one of the extensions below the pivot axis.

13. The structure according to claim 1, comprising a ladder which is movable between:

a ladder operating position in which the ladder provides access for personnel to climb onto the catwalk, and a ladder retracted, non-operating position in which the ladder is inaccessible from the ground and is concealed behind the single overhead beam when viewed from the direction of approaching traffic.

14. The structure according to claim 13, wherein the ladder is pivotable about a horizontal ladder pivot axis which extends substantially perpendicular to the single overhead beam.

15. The structure according to claim 14, wherein the ladder pivot axis is located behind a connection between the post and the single overhead beam.

16. The structure according to claim 15 wherein in the ladder operating position the ladder is concealed behind the post.

17. The structure according to claim 15 comprising a ladder actuator for moving the ladder between the ladder operating position and the retracted position.

18. The structure according to claim 13, wherein in the ladder operating position the ladder is concealed behind the post.

19. The structure according to claim 13, comprising a ladder actuator for moving the ladder between the ladder operating position and the retracted position.

* * * * *